United States Patent [19]

Vock et al.

[11] Patent Number: 4,632,567

[45] Date of Patent: Dec. 30, 1986

[54] VESSEL FOR RECEIVING, TRANSPORTING AND MIXING VISCOUS, ESPECIALLY HIGHLY VISCOUS, LIQUIDS

[75] Inventors: Georg F. Vock, Münster; Lutz Küter, Steinfurt, both of Fed. Rep. of Germany

[73] Assignee: BASF Farben & Fasern A.G., Hamburg, Fed. Rep. of Germany

[21] Appl. No.: 719,568

[22] Filed: Apr. 3, 1985

[30] Foreign Application Priority Data

Apr. 11, 1984 [DE] Fed. Rep. of Germany ..... 8411325

[51] Int. Cl.[4] ..... B01F 7/18

[52] U.S. Cl. ..... 366/276

[58] Field of Search ..... 366/243, 276, 278; 68/132; 99/348

[56] References Cited

U.S. PATENT DOCUMENTS

| | | | |
|---|---|---|---|
| 1,885,953 | 11/1932 | Schroeder | 366/278 X |
| 2,025,840 | 12/1935 | Wright | 68/132 |
| 2,309,617 | 1/1943 | Benson | 68/132 X |

*Primary Examiner*—Philip R. Coe

*Attorney, Agent, or Firm*—Wells & Wells

[57] ABSTRACT

A vessel for receiving, transporting and mixing viscous, especially highly viscous, liquids, with a motor-driven mixing paddle which is located on a shaft arranged offset relative to the center of the vessel and driven in a to-and-fro movement, and the height of which is less than the height of the vessel, wherein the drive shaft (3) is arranged vertically and the cross-section of the vessel (1) is essentially square, the drive shaft (3) being arranged centrally in one of the four quadrants (8) of the vessel (1).

10 Claims, 2 Drawing Figures

VESSEL FOR RECEIVING, TRANSPORTING AND MIXING VISCOUS, ESPECIALLY HIGHLY VISCOUS, LIQUIDS

BACKGROUND OF THE INVENTION

The field of the invention is vessels for receiving, transporting and mixing viscous liquids, and the invention is particularly concerned with vessels for handling highly viscous liquids with a motor driven mixing paddle which is located on a shaft arranged offset relative to the center of the vessel and is driven in a to-and-fro movement.

Vessels of this type are known and serve for the transport, preferably interdepartmental transport, and the simultaneous mixing of viscous, especially highly viscous, liquids.

The known vessels for this purpose are of an elongated trough-shaped design, and the drive shaft for the mixing paddle is located above the vessel edges in a container-like framework.

SUMMARY OF THE INVENTION

It is an object of the present invention to provide a compact closed vessel which can be transported in the simplest possible way by means of forklift trucks or the like and which serves for the storage, transport and mixing of viscous, preferably highly viscous, liquids.

This object is achieved by means of a vessel having a square cross-section, a paddle having a height which is less than the height of the vessel and a drive shaft for the paddle arranged vertically and centrally in one of the four quadrants of the vessel.

Advantageous embodiments of the closed, mixing vessel include:

(a) the drive shaft mounted on the underside and top side of the vessel;

(b) the drive motor for the drive shaft mounted on the top side of the vessel;

(c) the outer corner of a quadrant located opposite the quadrant receiving the drive shaft slopes inwards from the top edge of the vessel towards the underside of the vessel, and a discharge connection for the vessel is located on the underside of this triangular wall surface widening downwards;

(d) the mixing paddle is carried by the drive shaft, offset as seen in its longitudinal axis;

(e) a supporting stand suitable for a pallet is arranged on the vessel;

(f) bulges are provided in the side walls of the vessel;

(g) the top side of the vessel is formed by a truncated cone, the cone vertex of which terminates in the region of the upper mounting of the drive shaft in the quadrant receiving the drive shaft;

(h) the mixing paddle, as seen in its longitudinal axis, has a length which is approximately 20% less than the total length or width of the vessel; and (i) the connection of the drive shaft to the mixing paddle divides the latter in a ratio of 1:4.75.

The vessel according to the present invention is a compact and, therefore, stable vessel which can be transported in the manner of a pallet by forklift trucks or the like, but can also be moved in the same way on motor trucks or can be set up in the factory as a stationary vessel so as to save space.

BRIEF DESCRIPTION OF THE DRAWINGS

The present invention is shown in the appended drawings in an advantageous embodiment, wherein.

DESCRIPTION OF THE PREFERRED EMBODIMENTS

Figure 1:
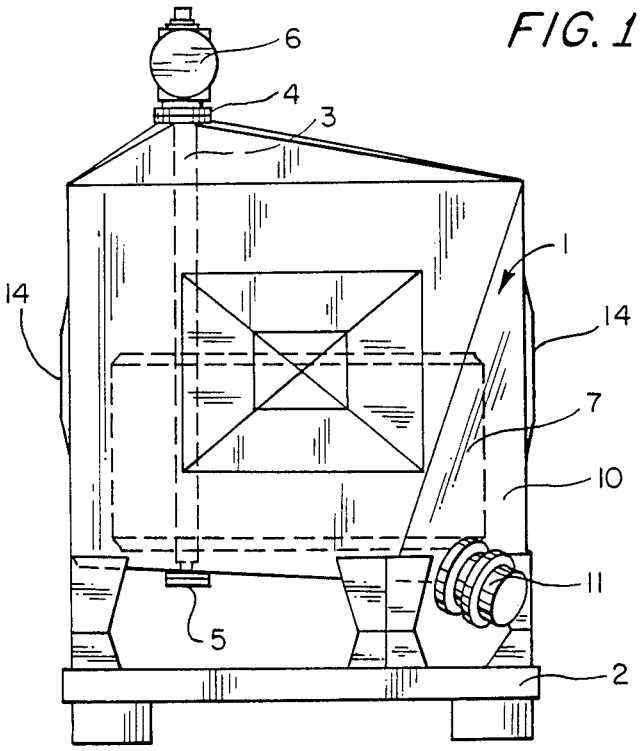
FIG. 1 is a side view of the vessel.

In the drawings, 1 denotes the actual vessel which, in the exemplary embodiment illustrated, is made square in a horizontal projection, the height of the vessel also corresponding approximately to the side length of the vessel. On the underside, the vessel is equipped with a supporting stand 2 which is designed in the form of a pallet and which thus makes it possible to transport the vessel, for example by means of forklift trucks or the like.

Inside the vessel there is a drive shaft 3 which is mounted in the upper region of the vessel at 4 and on the underside of the vessel at 5. Connected to the top side is a drive device 6 which drives the drive shaft 3 in a to-and-fro movement of the order of 80° to 90°.

The drive shaft 3 carries a mixing paddle 7 which is connected to the drive shaft offset, in such a way that, for example, the drive shaft divides the mixing paddle in a ratio of 1:4.75. The length of the mixing paddle is selected so that a free throughflow space remains between the outer edges of the mixing paddle and the inside faces of the vessel, the total length of the mixing paddle being approximately 20% less than the total length or width of the vessel.

Figure 2:
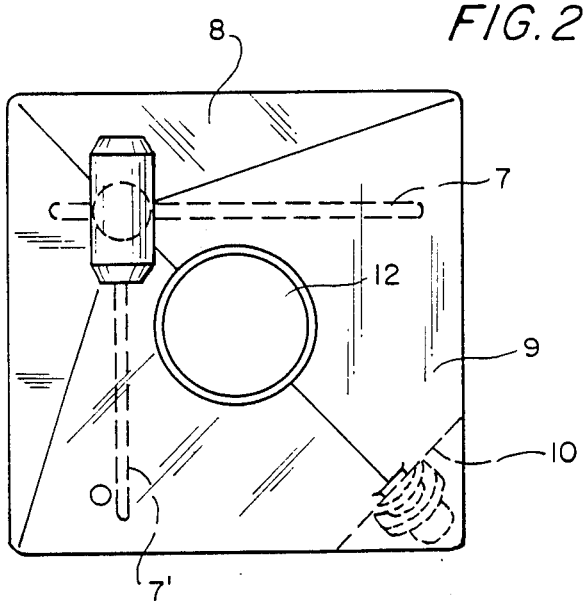
FIG. 2 is a top, plan view.

Paddle 7 is shown in FIG. 2 in dashed lines in its to-position and in its fro-portion 7' where the angle between the two positions is 80° to 90°.

The drive shaft 3, with the mixing paddle 7 located on it, is arranged offset in the vessel, specifically in a quadrant designated by 8 in FIG. 2, the drive shaft being arranged centrally in this quadrant 8. The vessel quadrant 9 located opposite the quadrant 8 has a corner region which slopes from the top edge of the vessel towards the underside of the vessel, thus producing a wall surface 10 which widens from the top downwards and in the lower part of which a discharge connection 11 is provided.

A filling orifice 12 is provided on the top side of the vessel.

As shown in FIG. 1, the side walls of the vessel can be equipped with bulges 14, as a result of which the stability of the vessel side walls is improved.

The top side of the vessel 1 is formed by an asymmetric truncated cone, the cone vertex of which terminates in the region of the upper mounting 4 of the drive shaft 3 in the quadrant 8 receiving the drive shaft 3.

What we claim is:

1. A vessel for receiving, transporting and mixing viscous, especially highly viscous, liquids, having an essentially square cross-section with first, second, third and fourth quadrants, a center defined by an intersection of said four quadrants, a drive shaft arranged offset relative to said center of the vessel in said first quadrant, a mixing paddle located on said shaft, and having means for driving said paddle in a to-and-fro movement, said vessel having a given height and said paddle having a height which is less than said given height, said shaft arranged vertically and centrally in said first quadrant, said third quadrant located opposite said first quadrant having an outer corner sloping inwards from a top edge of said vessel towards an underside of said vessel defining a triangular wall surface, and a discharge connection for said vessel located on an underside of said triangular wall surface widening downwards.

2. A vessel for receiving, transporting and mixing viscous, especially highly viscous, liquids, having an essentially square cross-section with first, second, third and fourth quadrants, two quadrants defining a total width, a center defined by an intersection of said four quadrants, a drive shaft arranged offset relative to said center of the vessel, a mixing paddle located on said shaft in said first quadrant and having means for driving said paddle in a to-and-fro movement, said vessel having a given height and said paddle having a height which is less than said given height, said shaft arranged vertically and centrally in said first quadrant, said paddle having a longitudinal axis and carried by said shaft, offset in said longitudinal axis, said paddle having a length which is approximately 20% less than said total width of said vessel in said longitudinal axis, said shaft having an upper mounting and said top side of said vessel defined by a truncated cone, said cone having a vertex terminating in proximity to said upper mounting of said drive shaft in said first quadrant receiving said drive shaft.

3. A vessel for receiving, transporting and mixing viscous, especially highly viscous, liquids, having an essentially square cross-section with first, second, third and fourth quadrants, two quadrants defining a total width, a center defined by an intersection of said four quadrants, a drive shaft arranged offset relative to said center of the vessel, a mixing paddle located on said shaft in said first quadrant and having means for driving said paddle in a to-and-fro movement, said vessel having a given height, and said paddle having a height which is less than said given height, said shaft arranged vertically and centrally in said first quadrant, said paddle having a longitudinal axis and carried by said shaft, offset in said longitudinal axis, said paddle having a length which is approximately 20% less than said total width of said vessel in said longitudinal axis, said shaft having a first end mounted on an underside and a second end mounted on a top side of said vessel, said means for driving said paddle mounted on said top side of said vessel, said shaft having an upper mounting and said top side of said vessel defined by a truncated cone, said cone having a vertex terminating in proximity to said upper mounting of said drive shaft in said first quadrant receiving said drive shaft.

4. The vessel of claim 1, wherein a supporting stand suitable for a pallet is connected to said underside of said vessel (1).

5. The vessel of claim 1, wherein said vessel has side walls and bulges are provided in said side walls of said vessel.

6. The vessel of claim 3, wherein a supporting stand suitable for a pallet is connected to said underside of said vessel (1).

7. The vessel of claim 3, wherein said vessel has side walls and bulges are provided in said side walls of said vessel.

8. The vessel of claim 1, wherein said drive shaft has a connection to said mixing paddle dividing said mixing paddle in a ratio of 1:4.75.

9. The vessel of claim 2, wherein said drive shaft has a connection to said mixing paddle dividing said mixing paddle in a ratio of 1:4.75.

10. The vessel of claim 3, wherein said drive shaft has a connection to said mixing paddle dividing said mixing paddle in a ratio of 1:4.75.

* * * * *